US006146228A

United States Patent [19]

Mougin et al.

[11] Patent Number: 6,146,228

[45] Date of Patent: Nov. 14, 2000

[54] METHOD FOR VACUUM ASSEMBLING A FLAT DISPLAY SCREEN

[75] Inventors: Stephane Mougin, Castelnau le Lez; Pascal Chassagne, Montpellier, both of France

[73] Assignee: Pixtech S.A., Rousset, France

[21] Appl. No.: 09/123,280

[22] Filed: Jul. 28, 1998

[30] Foreign Application Priority Data

Jul. 29, 1997 [FR] France ..... 97 09917

[51] Int. Cl.[7] ..... H01J 9/26; H01J 9/32

[52] U.S. Cl. ..... 445/25; 445/24

[58] Field of Search ..... 445/24, 25, 43

[56] References Cited

U.S. PATENT DOCUMENTS 5,820,434 10/1998 Itoh et al. ..... 445/25

*Primary Examiner*—Nimeshkumar D. Patel

*Assistant Examiner*—Michael J. Smith

*Attorney, Agent, or Firm*—Arthur L. Plevy; Buchanan Ingersoll PC

[57] ABSTRACT

The present invention relates to a method of assembly, in a furnace in vacuum conditions or under a neutral atmosphere, of two parallel plates leaving a closed internal space, consisting, in a first step, of performing a peripheral sealing by means of a first seal fusible at a first temperature, while maintaining open at least one opening of communication with the internal space and, in a second step, of closing the opening by means of a closing element with the interposition of a second seal fusible at a second temperature lower than the first temperature.

15 Claims, 1 Drawing Sheet

METHOD FOR VACUUM ASSEMBLING A FLAT DISPLAY SCREEN

BACKGROUND OF THE INVENTION

1. Field of the Invention

The present invention relates to a flat display screen. It more specifically applies to the assembly of two plates forming the bottom and the surface of the screen, and between which an internal spacing isolated from the outside is made.

2. Discussion of the Related Art

Conventionally, a flat screen is formed of two external generally rectangular spaced plates, for example made of glass. One plate forms the screen surface while the other forms the bottom of the screen generally provided with the emission means. These two plates are assembled by means of a sealing gasket. For a field effect display (FED) or a microtip display, or for a vacuum fluorescent display (VFD), vacuum is made in the space separating the two glass plates or this space contains a neutral atmosphere (rare gases).

FIG. 1 schematically shows in cross-sectional view the conventional structure of a microtip screen.

Such a microtip screen is essentially formed, on a first substrate 1, for example, made of glass, of a microtip cathode and of a grid. In FIG. 1, the cathode/grid assembly is designated with common reference 2. Cathode/grid 2 is placed opposite to a cathodoluminescent anode 3 made on a second transparent substrate 4, for example in glass, which forms the screen surface.

Cathode/grid 2 and anode 3 are made separately on the two substrates, or plates, 1 and 4, then assembled by means of a peripheral sealing gasket 5. An empty space 6 is formed between the two plates 1 and 4 to enable the circulation of the electrons emitted by the cathode towards anode 3.

The assembly of plates 1 and 4 is conventionally performed as follows.

First, spacers 7 for defining empty space 6 are glued onto cathode/grid 2. These spacers 7 are generally formed of glass balls regularly distributed so that space 6 between plates 1 and 4 is constant.

Then, cathode/grid 2 is submitted to a thermal vacuum processing having the purpose of degassing the cathode and evaporating the glue of spacers 7. A similar processing, not necessarily performed in vacuum conditions, is applied to anode 3.

According to a first conventional assembly method, a pumping tube 8 is provided on the free surface of a first plate 1. This tube 8 is, for example, in glass, and is sealed, by one of its open ends, above a hole made in plate 1 to establish a communication with space 6. According to this first method, tube 8 will be used in particular to create vacuum in space 6. Tube 8 is placed at the corner of plate 1 outside its useful surface. Then, a seal 5, for example a fusible glass cord, is deposited on the circumference of plate 1 or 4. Both plates 1 and 4 are then assembled by being pressed against each other, cathode/grid 2 facing anode 3, and this assembly being submitted to a temperature enabling the melting of cord 5. The obtained structure is then submitted, via tube 8, to a hot pumping which has the function of degassing space 6. This degassing is necessary, in particular, because of the gases emitted by fusible glass cord 5 during the sealing of the plates. Tube 8 is then closed at its free end after introducing therein a getter 9. The function of getter 9 is to absorb any contamination likely to appear during the subsequent operation of the screen. In FIG. 1, tube 8 has been shown as closed, that is, once the screen is completed.

A disadvantage of such an assembly method is that it is not adapted to a processing by screen batches. Indeed, although the step of sealing of the plates can be performed in a furnace containing several screens, the closing step is performed screen by screen.

To overcome this disadvantage, methods of vacuum assembly of a microtip screen which enable a batch processing have been provided.

FIG. 2 is a lateral view illustrating a conventional method of vacuum assembly of a microtip screen.

In such a process, plates 1 and 4 are maintained in vacuum conditions from their respective degassing thermal processings on and are placed against each other with an interposed fusible glass seal 5'. Peripheral fusible glass seal, or frame, 5' exhibits, before assembly, irregular surfaces of contact with plates 1 and 4. The whole is maintained under pressure, for example, by means of pliers 10. The whole as shown in FIG. 2 is then submitted to a temperature which enables the softening of frame 5' while remaining lower than its melting temperature. At such a softening temperature, the leaks 12 linked with the irregular surfaces of frame 5' are meant to enable an outlet of the gases emitted by the fusible glass frame inside the screen before the glass sealably assembles the two plates during its melting. This melting of frame 5' is obtained by bringing the whole to a temperature higher than the melting temperature of frame 5', which then causes, under the effect of the pliers, a crushing of frame 5' and the assembly of the screen, the distance between the plates being fixed by the spacers. As an alternative, the assembly formed of plates 1 and 4 and of frame 5' is progressively brought from the ambient temperature to the melting temperature, sufficiently slowly to enable the outlet of the gases emitted by leaks 12 before the sealed assembly.

In FIG. 2, the screen has been shown without any pumping tube. Such a pumping tube is no longer necessary in such an assembly method. The screen is however generally always associated with a tube (not shown) or with a glass box for housing a getter, not shown. This tube or box is also assembled by means of a fusible glass cord to one of the screen plates. The assembly of the tube or box is performed at the same time as the assembly of plates 1 and 4.

Although such a method is well adapted to a batch processing, it has the disadvantage of not sufficiently eliminating from inside the screen the gases emitted by cord 5'. Indeed, the fusible glass continues to degas when brought from its softening temperature to its melting temperature.

Another disadvantage of this assembly method is that the amount of degassing performed through leaks 12 is difficult to reproduce from one screen to another. Indeed, the surface irregularities of seal 5' are random and the flow rate of leaks 12 can thus not be controlled or reproduced. In addition to the fact that the remaining of the gases emitted by cord 5' inside the screen is prejudicial to the lifetime of the manufactured screens, this lifetime very significantly varies from one screen to another, though submitted to the same assembly process.

SUMMARY OF THE INVENTION

The present invention aims at overcoming the disadvantages of conventional methods of assembly of a flat display screen, by providing a method of assembly under vacuum conditions, or under a neutral atmosphere, which optimizes the elimination of the emitted gases, within the screen, by the gasket for sealing the plates together, and which is adapted to a batch processing.

The present invention also aims at providing an assembly method in which the vacuum quality, or the neutrality of the atmosphere, obtained inside the screen is reproducible.

To achieve these objects, the present invention provides a method of assembly, in a furnace in vacuum conditions or under a neutral atmosphere, of two parallel plates leaving a closed internal space, consisting of:

in a first step, performing a peripheral sealing by means of a first seal fusible at a first temperature, while maintaining open at least one opening of communication with the internal space; and in a second step, closing the opening by means of a closing element with the interposition of a second seal fusible at a second temperature lower than the first temperature.

According to an embodiment of the present invention, the opening is sized so that the second seal is of a much lower size than the first seal.

According to an embodiment of the present invention, the materials constitutive of the seals are chosen so that the melting temperature of the first seal is higher than the melting temperature of the second seal.

According to an embodiment of the present invention, the material constitutive of the seals has a thermal expansion coefficient close to that of the plates and of the closing element.

According to an embodiment of the present invention, the material constitutive of the seals is fusible glass.

According to an embodiment of the present invention, the parallel plates respectively form the bottom and the surface of a flat display screen, the internal space being formed between the plates by means of spacers permanently added on one of the plates before the first sealing step.

According to an embodiment of the present invention, the opening is formed in one of the plates.

According to an embodiment of the present invention, the closing element is formed of a box for housing a getter meant to communicate with the internal space once the screen is closed, the free edges of this box being meant to surround the opening with the interposition of the second seal.

According to an embodiment of the present invention, the closing element is formed of a circular pellet of a higher diameter than the diameter of the opening.

According to an embodiment of the present invention, the opening is formed in a box for housing a getter communicating with the internal space and added, in the first step, on the external surface of one of the plates, the free edges of this box surrounding an opening of communication with the internal space, formed in this plate.

According to an embodiment of the present invention, a box, of elongated shape and meant to house a getter, is added during the first step along an edge of the assembly formed of the plates, the respective edges of the plates being shifted so that the box communicates with the internal space, and the opening meant to be closed by means of the pellet being formed in a wall of the box.

According to an embodiment of the present invention, a groove is formed in the vicinity of the circumference of the opening, a rib of opposite shape being formed to protrude from the surface of the pellet meant to obturate the opening, and the cross-sectional width of the second seal being higher than the width of the groove.

According to an embodiment of the present invention, the method consists of:

in the first sealing step:

adding the first seal on a surface of a first plate facing a surface to be assembled of a second plate;

bringing the assembly thus formed to the first temperature, by pressing the plates against each other and by maintaining open the opening of communication with the internal space;

cooling down the assembly once the sealing has been performed; and in the second closing step:

adding the element of closing of the opening with the interposition of the second seal; and bringing the assembly thus formed to the second temperature, by exerting a mechanical pressure on the closing element towards the opening.

The foregoing objects, features and advantages of the present invention will be discussed in detail in the following non-limiting description of specific embodiments, in conjunction with the accompanying drawings.

DETAILED DESCRIPTION

Figure 1:
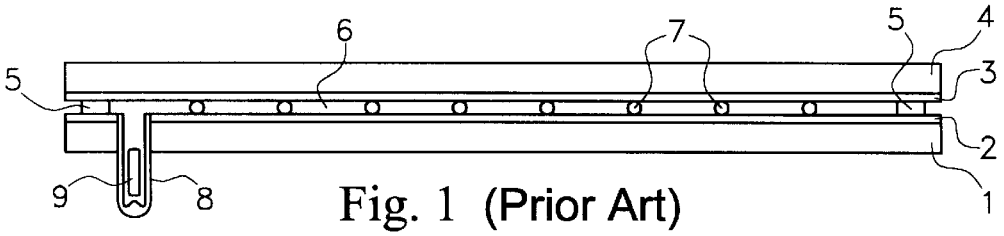
Fig. 1 (Prior Art)
FIGS. 1 and 2, previously described, are meant to show the state of the art and the problem to solve.
Figure 2:
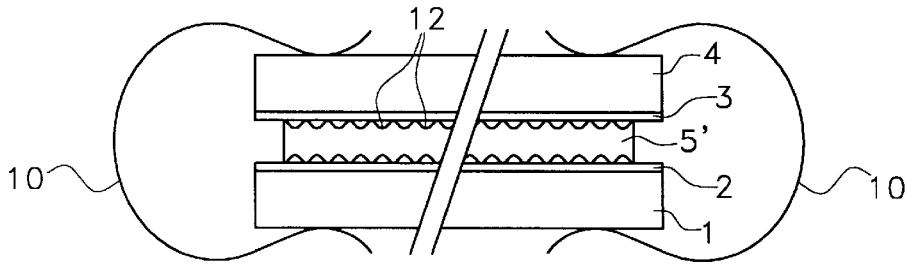
Fig. 2 (Prior Art)

The same elements have been referred to with the same references in the different drawings. For clarity, the representations of the drawings are not to scale and only those elements necessary to the understanding of the present invention have been shown in the drawings and will be described hereafter.

A characteristic of the present invention is to dissociate the assembly under vacuum conditions or under a neutral atmosphere of the plates constitutive of a flat display screen from the closing of a space formed between the plates.

According to the present invention, the plates of a screen to be assembled are individually submitted to the conventional degassing processings before being introduced in a furnace of assembly under vacuum conditions or under a neutral atmosphere. These plates are placed facing each other with the interposition of a peripheral seal and, according to the present invention, an opening of access to the internal screen space is left open during the peripheral sealing to enable an outlet of the gases emitted, during the sealing, by the peripheral seal, for example made of fusible glass.

This opening is meant to be closed, in a second step of the method according to the present invention also performed in a furnace under vacuum conditions or under a neutral atmosphere , by means of a closing element, for example made of glass, sealed by means of a second peripheral seal, for example, made of fusible glass.

A characteristic of the present invention is that the sealing material of this element has a lower melting temperature than the material of peripheral sealing of the screen plates. Thus, the degassing of the first seal is minimized during the actual screen closing.

Another characteristic of the present invention is that the opening enabling the outlet of the gases during the first step has a low size such that the quantity of fusible material required for its closing is much lower than the quantity of fusible material required for the peripheral sealing of the plates. This minimizes the amount of gas likely to contaminate the internal screen space which, according to the present invention, now only comes from the closing of the opening of reduced size.

The present invention will be described hereafter in relation with a use of fusible glass for the sealing and closing gaskets. Although glass is a preferred material due to the material (generally glass) constitutive of the plates to be assembled and, for the peripheral sealing, due to its isolating properties, other fusible materials, for example, indium, respecting the characteristics described hereafter in relation with fusible glass, can however be used.

Figure 3:
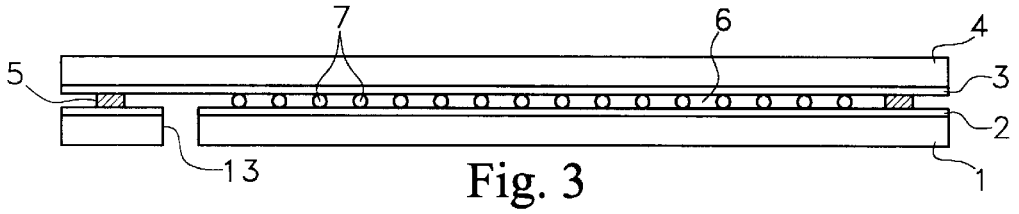
FIG. 3 shows a flat display screen in a first step of assembly of the method according to the present invention.

FIG. 3 is a cross-sectional view illustrating an embodiment of the first step of assembly of the method of the present invention.

FIG. 3 very schematically shows a microtip screen formed, conventionally, on a first substrate 1, for example, made of glass, of a cathode with microtips and of a grid designated by common reference 2. Cathode/grid 2 is placed facing a cathodoluminescent anode 3 made on a second transparent substrate 4 forming the screen surface. Spacers 7 are regularly distributed between cathode/grid 2 and anode 3 to define an empty space 6.

In the first step of the assembly method according to the present invention, a glass seal 5, fusible at a first temperature (T1) is interposed between the circumferences of plates 1 and 4. The assembly is placed in a furnace under vacuum conditions (not shown) and is progressively brought (for example, within one hour) to temperature T1of melting of the glass forming seal 5. During this step, the plates are pressed against each other by means of conventional tools.

The gases emitted by cord 5 towards the internal space are, according to the present invention, permanently pumped from an opening 13 formed, for example, in plate 1 since the inside of the screen is under vacuum conditions. In the case where the sealing is performed under a neutral atmosphere (in a rare gas), the gas outlet is obtained by controlling the quality of the furnace atmosphere, especially, by organizing a flow of the rare gas(es) forming the neutral atmosphere.

It should be noted that, according to the present invention, peripheral glass cord 5 does not require to be grooved at its surface since the gas outlet is performed through opening 13.

Once the peripheral sealing has been performed, the furnace temperature is decreased. This cooling down can, if necessary, be aided.

Figure 4:
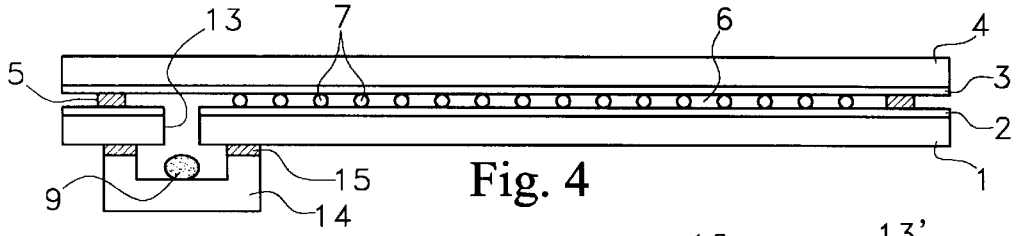
FIG. 4 shows the screen of FIG. 3 during a second step of assembly of the method according to the present invention.

FIG. 4 illustrates the second step of the method according to the present invention of closing of opening 13 of the screen shown in FIG. 3.

In this second step, an element 14 of closing of opening 13 is placed with the interposition of a second glass seal, or cord, 15 fusible at a temperature T2lower than temperature T1of melting of peripheral seal 5. Element 14 is maintained by mechanical pressure and the furnace is brought to temperature T2to cause the melting of seal 15 and the closing of the screen. If desired, the introduction of element 14 and of seal 15 can be performed during the temperature decrease at the end of the first step, without it being necessary to completely cool down the screen.

In the embodiment of closing element 14 shown in FIG. 4, this element is formed of a box of reception of a getter 9 introduced during the placing of element 14.

An advantage of the present invention is that, during the second closing step, the glass constitutive of cord 5 hardly degasses at all due to the difference between temperatures T2and T1. Further, next to all gases likely to be emitted by cord 5 have been pumped in the first step.

Preferably, screen closing cord 15 has grooved surfaces to generate microleaks to the outside of the screen in the closing step. The quality of the vacuum or of the neutral atmosphere inside the screen is thus optimized.

An advantage of the present invention is that the assembly and closing method is perfectly reproducible from one screen to another, since the level of vacuum obtained in internal space 6 no longer depends on the shape of the peripheral cord. The influence of the possible differences between the microleaks of seals 15 from one screen to another is negligible due to the small size of cord 15.

Another advantage of the present invention is that it minimizes the contamination of internal space 6 by a degassing of the layers constitutive of the screen cathode and anode. Indeed, the cathode and the anode of a microtip screen degas exponentially with the temperature increase. In the first step, the high degassing is exhausted from the screen through opening 13. During the second step, the cathode and the anode degas much less due to the lower temperature used. Thus, the screen lifetime is further improved.

It should be noted that although, in a preferred embodiment, the screen is maintained under vacuum conditions between the two steps for reasons of process duration, it is possible to put the screen back under the ambient atmosphere between the two steps, the pumping of the internal space then occurring as the furnace is put under vacuum conditions before the closing of the second step.

According to a preferred embodiment of the present invention, the respective constitutions of the glasses of cords 5 and 15 are chosen to exhibit substantially different melting temperatures, for example, distant of approximately 50° C. from each other. As a specific example of embodiment, temperature T1is included between 450 and 550° C. and temperature T2is included between 350 and 450° C.

It should however be noted that as an alternative, the same glass may be used for both cords 5 and 15. Indeed, during the first step, the glass of cord 5 must melt sufficiently to fill up the steps (not shown) of the surface of cathode/grid 2 and of anode 3, connected to the electric connection tracks which extend to the edges of plates 1 and 4. Further, due to the materials constitutive of these connection tracks, the melting must be sufficient to ensure a metal/glass cohesion. However, in the second step, the sealing performed is a glass on glass sealing which requires, for a given fusible glass, a lower temperature. Further, the respective surfaces to be assembled are more regular than during the first step. Thus, even by using an identical fusible glass, the two steps can be implemented at different temperatures. Temperature T2can, for example, be lower by on the order of 20° C. than temperature T1.

Of course, the glasses constitutive of cords 5 and 15 will be chosen to be compatible (in particular, for their expansion coefficients) with the glasses constitutive of plates 1 and 4 and of closing element 14. As a specific example of embodiment, a lead glass can be used for the assembly step and a boron glass can be used for the closing step.

Microballs can, if necessary, be contained in fusible glass cords 5 and 15 to avoid the appearance of microcracks in the obtained sealings. Indeed, since cords 5 and 15 are, during their respective meltings, crushed by mechanical pressure means, the possible presence of air microbubbles in the glass risks, by its crushing, to form a microleak communicating on either side of the obtained seal. By using a compound material formed of a fusible glass and of microballs, for example, made of glass, the melting temperature of which is much higher than temperature T1, the crushing of the fusible glass seal is maintained constant and the possible air microbubbles are thus confined in the obtained seal. The glass microballs preferably have a diameter lower than 100 μm, for example, on the order of 4 to 5 μm.

The duration (for example, on the order of ten minutes) of the second closing step can be much lower than the duration (for example, on the order of one hour) of the first sealing step. Indeed, during the first step, it is desired to obtain a sufficiently slow temperature increase to enable a maximum gas emission by peripheral seal 5 and to let the gases out. In the second step, this is not compulsory due to the low quantity of fusible glass used.

It should be noted that several openings 13 can be made to improve, in particular for large size screens, the degassing performed during the first step by distributing the points of communication with internal space 6. However, attention will be paid not to generate, by this multiplication of openings 13, too high a degassing during the second closing step.

Figure 5:
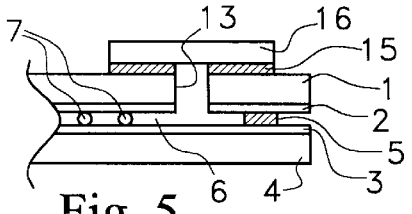
FIG. 5, 6, and 7 illustrate different embodiments of a flat display screen adapted to implementing the method according to the present invention.

FIG. 5 is a partial cross-sectional view of a screen assembled according to the present invention illustrating a second embodiment of a closing element. This embodiment is more specifically meant for a screen in which the getter requires no reception volume but is implemented in the form of thin layers inside empty state 6. According to this embodiment, pellet 16, for example, of circular shape, is added on opening 13 which is also circular.

Figure 6:
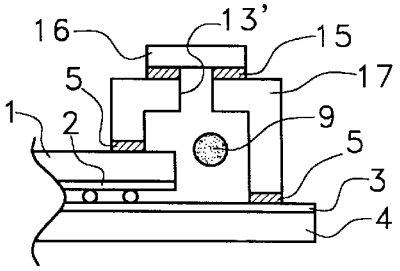

FIG. 6 shows a third embodiment of a flat screen assembled by implementing the method of the present invention. According to this embodiment, getter 9 is housed in a box extending along a whole side of the screen. In this case, one of the plates, for example, plate 1 of cathode/grid 2, does not extend to the edge of the other plate 4 and a box 17 of generally elongated shape rests, for example, by the free end of a first longitudinal wall, on the internal surface of plate 4 (the anode) and, by the free end of a second longitudinal wall, on the external surface of plate 1.

Box 17 includes an opening 13' of small size meant to be obturated in the second step of the method according to the present invention by means of a pellet 16 with the interposition of a fusible glass seal 15.

Such an embodiment provides a greater volume for getter 9. Further, it has the advantage of not requiring to bore one of plates 1 or 4 and avoids that chips damage cathode/grid 2 or anode 3 during this boring.

It should be noted that the closing of a box by means of a pellet can also apply to a box such as described in relation with FIG. 4. In this case (not shown), the box is sealed to a plate during the first step and a closing pellet is added in the second step, on an opening formed in the box.

Figure 7:
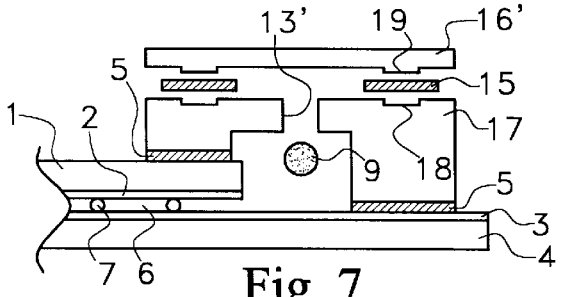

FIG. 7 shows an alternative embodiment of a pellet 16' for closing an opening 13 of a screen according to the present invention.

In FIG. 7, the use of elongated box 17 which is shown in FIG. 6 has been assumed. It should however be noted that the embodiment of pellet 16' of FIG. 7 also applies to the case of a closing of an opening 13 made in one of the screen plates.

According to this embodiment, a groove 18 is formed around opening 13' on the external surface of box 17. A rib 19 of opposite shape is formed on the surface of pellet 16' meant to bear against the box. Fusible glass cord 15 has, in cross-section, a higher width than the width of groove 18.

An advantage of such an embodiment is that it minimizes the risks of occurrence of microleaks, even in the absence of use of microballs in fusible glass 15, due to the passing of steps performed by cord 15 once melted.

Another advantage of this embodiment is that it improves the tightness of the closing, in particular, if seal 15 is not made of fusible glass but of another material, for example, indium having a lower ability to spread on a substrate.

It should be noted that although the screen closing is performed, preferably, on the side of cathode/grid 2, in order not to create any excrescence with respect to the screen surface formed by plate 4 of anode 3, nothing technically forbids to have this closing performed on the anode side, that is, on the side of substrate 4.

Of course, the present invention is likely to have various alterations, modifications, and improvements which will readily occur to those skilled in the art. In particular, although the foregoing description has been made in relation with a microtip screen, the present invention applies whatever the type of flat screen adapted to be assembled under vacuum conditions by means of a peripheral seal. Further, other shapes of closing elements or getter housing boxes may be used, provided that the quantity of fusible material required for the screen closing is lower than the quantity of fusible material for sealing together the plates associated, if desired, with an elongated box, and that the closing can be performed at a temperature lower than the temperature of the first sealing step. Further, other types of glass than those previously indicated as an example may be used. Similarly, the melting temperatures given hereabove only form a specific example of implementation.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A method of assembly, in a furnace in vacuum conditions or under a neutral atmosphere, of two parallel plates (1, 4) leaving a closed internal space (6), including:

in a first step, performing a peripheral sealing by means of a first seal (5) fusible at a first temperature (T1), while maintaining open at least one opening (13, 13') of communication with the internal space; and in a second step, closing the opening by means of a closing element (14, 16, 16') with the interposition of a second seal (15) fusible at a second temperature (T2) lower than the first temperature.

2. The method of claim 1, wherein the opening (13, 13') is sized so that the second seal (15) is of a much lower size than the first seal (5).

3. The method of claim 1, wherein the materials of the seals (5, 15) are chosen so that the melting temperature (T1) of the first seal is higher than the melting temperature (T2) of the second seal.

4. The method of claim 1, wherein the materials of the seals (5, 15) have a thermal expansion coefficient close to that of the plates (1, 4) and of the closing element (14, 16, 16').

5. The method of claim 1, wherein the seals (5, 15) are made of fusible glass.

6. The method of claim 1, wherein the parallel plates (1, 4) respectively form the bottom and the surface of a flat display screen, the internal space (6) being formed between the plates by means of spacers (7) permanently added on one of the plates before the first sealing step.

7. The method of claim 1, wherein the opening (13) is formed in one of the plates (1, 4).

8. The method of claim 1, wherein the closing element is formed of a circular pellet (16, 16') of a higher diameter than the diameter of the opening (13, 13').

9. The method of claim 8, wherein a groove (18) is formed in the vicinity of the circumference of the opening (13'), a rib (19) of complementary shape being formed to protrude from the surface of said pellet (16') and the cross-sectional width of the second seal (15) being higher than the width of the groove.

10. The method of claim 1, consisting of:

in the first sealing step:

adding the first seal (5) on a surface of a first plate (4) facing a surface to be assembled of a second plate (1);

bringing the assembly thus formed to the first temperature (T1), by pressing the plates against each other and by maintaining open the opening (13) of communication with the internal space (6);

cooling down the assembly once the sealing has been performed; and in the second closing step:

adding the closing element (14, 16, 16') with the interposition of the second seal (15); and bringing the assembly thus formed to the second temperature (T2), by exerting a mechanical pressure on the closing element towards the opening.

11. The method of claim 1, wherein the parallel plates (1, 4) respectively form the bottom and the surface of a flat display screen, the internal space (6) being formed between the plates by means of spacers (7) permanently added on one of the plates before the first sealing step, and wherein the opening (13) is formed in one of the plates (1, 4).

12. The method of claim 11, wherein the closing element is formed of a box (14) for housing a getter (9) communicating with the internal space (6) once the screen is closed, the free edges of this box surrounding the opening (13) with the interposition of the second seal (15).

13. The method of claim 1, wherein the parallel plates (1, 4) respectively form the bottom and the surface of a flat display screen, the internal space (6) being formed between the plates by means of spacers (7) permanently added on one of the plates before the first sealing step, and wherein the closing element is formed of a circular pellet (16, 16') of a higher diameter than the diameter of the opening (13, 13').

14. The method of claim 13, wherein the opening is formed in a box for housing a getter (9) communicating with the internal space (6) and added, in the first step, on the external surface of one of the plates (1, 4), the free edges of this box surrounding an opening of communication with the internal space, formed in this plate.

15. The method of claim 13, wherein a box (17), of elongated shape, housing a getter (9), is added during the first step along an edge of the assembly formed of the plates (1, 4), the respective edges of the plates being shifted so that the box communicates with the internal space (6), and the opening (13') to be closed by the pellet (16, 16') being formed in a wall of the box.

* * * * *